US008025372B2

(12) United States Patent
Umeda et al.

(10) Patent No.: US 8,025,372 B2
(45) Date of Patent: Sep. 27, 2011

(54) INK JET PRINTER

(75) Inventors: Takaichiro Umeda, Nagoya (JP); Fumio Nakazawa, Okazaki (JP); Hirotake Nakamura, Nagoya (JP); Kosuke Nukui, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 970 days.

(21) Appl. No.: 11/998,488

(22) Filed: Nov. 30, 2007

(65) Prior Publication Data

US 2008/0129801 A1 Jun. 5, 2008

(30) Foreign Application Priority Data

Nov. 30, 2006 (JP) ..... 2006-324543

(51) Int. Cl.
*B41J 2/175* (2006.01)
*B41J 2/195* (2006.01)

(52) U.S. Cl. ..... 347/85; 347/7; 347/86

(58) Field of Classification Search ..... 347/7, 85, 347/86, 87

See application file for complete search history.

(56) References Cited

U.S. PATENT DOCUMENTS

| | | | | |
|---|---|---|---|---|
| 5,221,935 | A | 6/1993 | Uzita | |
| 6,076,920 | A | 6/2000 | Zapata et al. | |
| 6,966,641 | B2 * | 11/2005 | Taniguchi et al. | 347/86 |
| 7,225,670 | B2 | 6/2007 | Tsukada et al. | |
| 2006/0284944 | A1 * | 12/2006 | Kudo et al. | 347/85 |
| 2007/0085865 | A1 | 4/2007 | Tsukada et al. | |

FOREIGN PATENT DOCUMENTS

| | | |
|---|---|---|
| JP | 63-77741 | 5/1988 |
| JP | 3-13393 | 1/1991 |
| JP | 9-235561 | 9/1997 |
| JP | 2000-349436 | 5/2004 |
| JP | 2000-147055 | 10/2007 |
| JP | 2000-349436 | 10/2007 |
| WO | WO 98/31548 | 7/1998 |

* cited by examiner

*Primary Examiner* — Matthew Luu
*Assistant Examiner* — Jannelle M Lebron
(74) *Attorney, Agent, or Firm* — Frommer, Lawrence & Haug LLP

(57) ABSTRACT

A main ink tank side connector of an inkjet printer moves, with respect to a sub ink tank side connector, between a first positional relationship where the two connectors are connected, and a second positional relationship where the main ink tank side connector is disconnected from the sub ink tank side connector. A wall member surrounds at least a connection portion of the two connectors when they are in the first positional relationship. A breaking portion breaks an ink film formed within an inner space of the wall member. The ink film is formed when the main ink tank side connector moves with respect to the sub ink tank side connector from the first positional relationship to the second positional relationship. The breaking portion breaks the ink film in a state where at least a part of the ink film exists within the wall member.

16 Claims, 12 Drawing Sheets

INK JET PRINTER

CROSS-REFERENCE TO RELATED APPLICATION

This application claims priority to Japanese Patent Application No. 2006-324543, filed on Nov. 30, 2006, the contents of which are hereby incorporated by reference into the present application.

BACKGROUND OF THE INVENTION

1. Field of the Invention

The present invention relates to a station type ink jet printer supplying ink within a main ink tank to a sub ink tank.

2. Description of the Related Art

A station type inkjet printer is taught in Japanese Patent Application Publication No. 2004-181952. The station type inkjet printer is provided with a main ink tank side connector that is to be connected with a main ink tank, and a sub ink tank side connector that is to be connected with a sub ink tank. The main ink tank side connector is capable of moving with respect to the sub ink tank side connector between a first positional relationship and a second positional relationship. When the main ink tank side connector and the sub ink tank side connector are positioned in the first positional relationship, the sub ink tank side connector and the main ink tank side connector are in a connected state, and ink is supplied from the main ink tank to the sub ink tank. When the supplying of ink ends, the main ink tank side connector and the sub ink tank side connector are separated and the main ink tank side connector and the sub ink tank side connector are positioned in the second positional relationship.

SUMMARY OF THE INVENTION

When the main ink tank side connector is moving with respect to the sub ink tank side connector from the first positional relationship to the second positional relationship, ink droplets may disperse from a connection portion between the two. The dispersal of ink droplets will make the interior of a printer dirty.

The present inventor experimentally produced an ink jet printer that had a wall member provided at a main ink tank side connector side and/or a sub ink tank side connector side. This wall member surrounded a connection portion of the main ink tank side connector and the sub ink tank side connector when the main ink tank side connector and the sub ink tank side connector are positioned in the first positional relationship. However, this wall member was unable to adequately prevent the dispersal of ink droplets.

When the present inventor researched the cause thereof, the following new problem was discovered.

In the aforementioned experimental printer, ink collects in the inner space of the wall member. When the main ink tank side connector is moving with respect to the sub ink tank side connector from the first positional relationship to the second positional relationship, this collected ink forms an ink film between the sub ink tank side connector and the inner surface of the wall member. When the main ink tank side connector and the sub ink tank side connector are separated, the ink film is pulled by the sub ink tank side connector and the wall member, and breaks when it reaches a boundary point.

At this juncture, if the ink film breaks at a location higher than the height of the wall member, i.e. at a location that is beyond the wall member, the ink film breaks at a position where the wall member is not present. Ink droplets of the ink film, which has broken where the wall member is not present, pass over this wall member and disperse.

The present specification has taken the above point into consideration, and aims to suppress the dispersal of ink droplets when the main ink tank side connector moves with respect to the sub ink tank side connector from the first positional relationship to the second positional relationship.

The present specification teaches a station type inkjet printer. The ink jet printer includes a casing, a sub ink tank, an ink jet head, a main ink tank side connector, a sub ink tank side connector, a wall member and a breaking portion. The casing includes a space for housing a main ink tank. Ink within the main ink tank is to be supplied to the sub ink tank. Ink within the sub ink tank is to be supplied to the ink jet head. The main ink tank side connector is to be connected with the main ink tank, and the sub ink tank side connector is to be connected with the sub ink tank. The main ink tank side connector is capable of moving with respect to the sub ink tank side connector between a first positional relationship and a second positional relationship. The main ink tank side connector is connected with the sub ink tank side connector in the first positional relationship, but it is disconnected from the sub ink tank side connector in the second positional relationship. The wall member surrounds at least a connection portion of the main ink tank side connector and the sub ink tank side connector when both connectors are positioned in the first positional relationship. The breaking portion breaks an ink film formed within an inner space of the wall member. The ink film is formed when the main ink tank side connector moves with respect to the sub ink tank side connector from the first positional relationship to the second positional relationship. The breaking portion breaks the ink film in a state where at least a part of the ink film exists within the wall member.

With this ink jet printer, the ink film may be formed when the main ink tank side connector and the sub ink tank side connector are disconnected, i.e. when the main ink tank side connector moves with respect to the sub ink tank side connector from the first positional relationship to the second positional relationship. The ink film is broken in the state where at least a part of the ink film exists within the wall member. As a result, it is possible to prevent ink droplets that have been formed from the broken ink film from passing over the wall member and dispersing.

The phrase, "the main ink tank side connector being capable of moving with respect to the sub ink tank side connector," means: a case where only the main ink tank side connector moves; a case where only the sub ink tank side connector moves; or a case where both the main ink tank side connector and the sub ink tank side connector move.

DETAILED DESCRIPTION OF THE INVENTION

Figure 1:
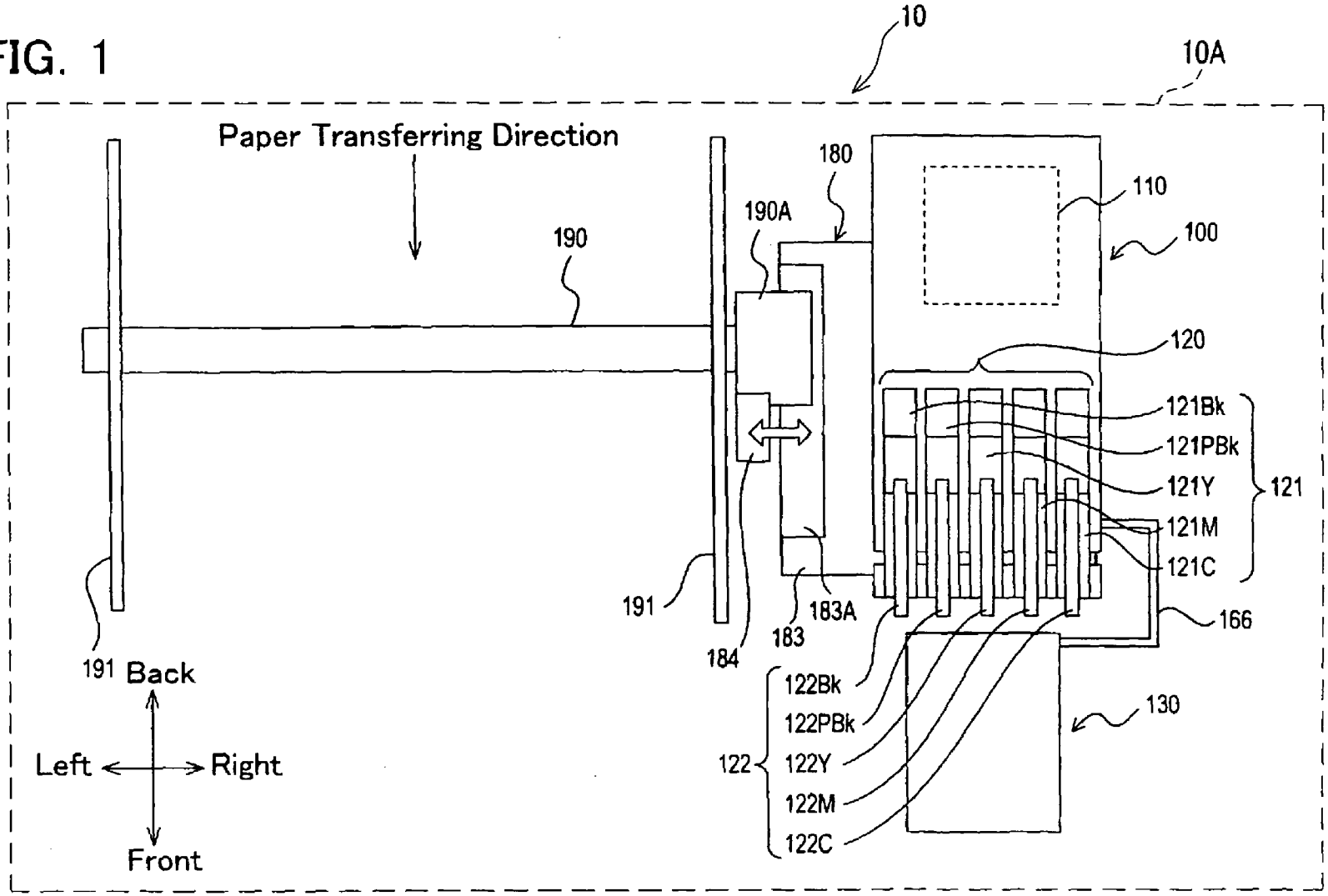
FIG. 1 is a schematic view from above of an image forming portion of an ink jet printer of the present embodiment.

Below, station type inkjet printer embodiments of the present teaching will be described together with figures.

First Embodiment

An ink jet printer 10 (also referred to below as printer 10) forms images on a recording medium such as recording paper (hereafter referred to as paper) by the generally known technique of discharging minute ink droplets toward the paper. In the case where a color image is to be formed, color images of various colors are formed by means of overlapping inks such as cyan, magenta, yellow, and photo black, etc. In the printer 10, during monochrome printing, images are formed utilizing specialized black ink (i.e. pigment ink) that is provided separately from the photo black ink. The ink jet printer 10 includes a casing 10A for housing various elements described below.

Station type ink supply is as follows: when ink is to be supplied to a sub ink tank 121 (to be described), a main ink tank unit 130 (to be described) and the sub ink tank 121 are connected, and ink is supplied to the sub ink tank 121 from a main ink tank 131. The main ink tank unit 130 and the sub ink tank 121 are separated when ink is not to be supplied to the sub ink tank 121 during image formation, etc. In the printer 10, the main ink tank unit 130 and the sub ink tank 121 are connected when the amount of ink remaining in the sub ink tank 121 falls below a predetermined amount, and ink is replenished with the sub ink tank 121. When the amount of ink remaining in the sub ink tank 121 rises to above a predetermined amount the main ink tank unit 130 and the sub ink tank 121 are placed in a separated state.

1. Recording Head Unit

As shown in FIG. 1, a recording head unit 100 includes a recording head 110, a sub ink tank unit 120, etc. The recording head 110 discharges ink droplets onto paper. The sub ink tank unit 120 supplies ink to the recording head 110. During image formation, the recording head unit 100 moves in a direction which is perpendicular to a paper transferring direction and which is parallel with a recording surface of the paper (i.e. the left-right direction in FIG. 1). That is, the recording head unit 100 moves (i.e. back and forth) in a main scanning direction. A plurality of nozzles (not shown) is provided for each color of ink in a surface of the recording head unit 110 that is facing the paper being transported. These nozzles are for discharging the ink. These nozzles for each color are aligned in a row in a direction parallel to the paper transferring direction.

The sub ink tank unit 120 includes a plurality of sub ink tanks 121C, 121M, 121Y, 121PBk, 121Bk aligned in series in the main scanning direction; pushing levers 122C, 122M, 122Y, 122PBk, 122Bk are for pushing the sub ink tanks 121C, 121M, 121Y, 121PBk, 121Bk. The following inks are filled into the sub ink tanks: cyan (C) ink in the sub ink tank 121C, magenta (M) ink in the sub ink tank 121M, yellow (Y) ink in the sub ink tank 121Y, photo black (PBk) ink in the sub ink tank 121PBk, and black (Bk) ink in the sub ink tank 121Bk. The sub ink tanks 121C, 121M, 121Y, 121PBk, and 121Bk differ only in the ink with which they are filled, and are otherwise identical. Below, when these sub ink tanks are referred to collectively, they will be termed the sub ink tanks 121. Further, the pushing levers 122C, 122M, 122Y, 122PBk, and 122Bk differ only in which of the sub ink tanks 121 they push. Below, when these pushing levers are referred to collectively, they will be termed the pushing levers 122. Further, the sub ink tanks 121 are configured such that they can deform resiliently (i.e. expand and contract) in a direction at right angles to the paper transferring direction and the main scanning direction (i.e. an up-down direction of the printer 10 in the present embodiment). Specifically, as shown in FIG. 2, each sub ink tank 121 is configured in a bellows shape.

Figure 2:
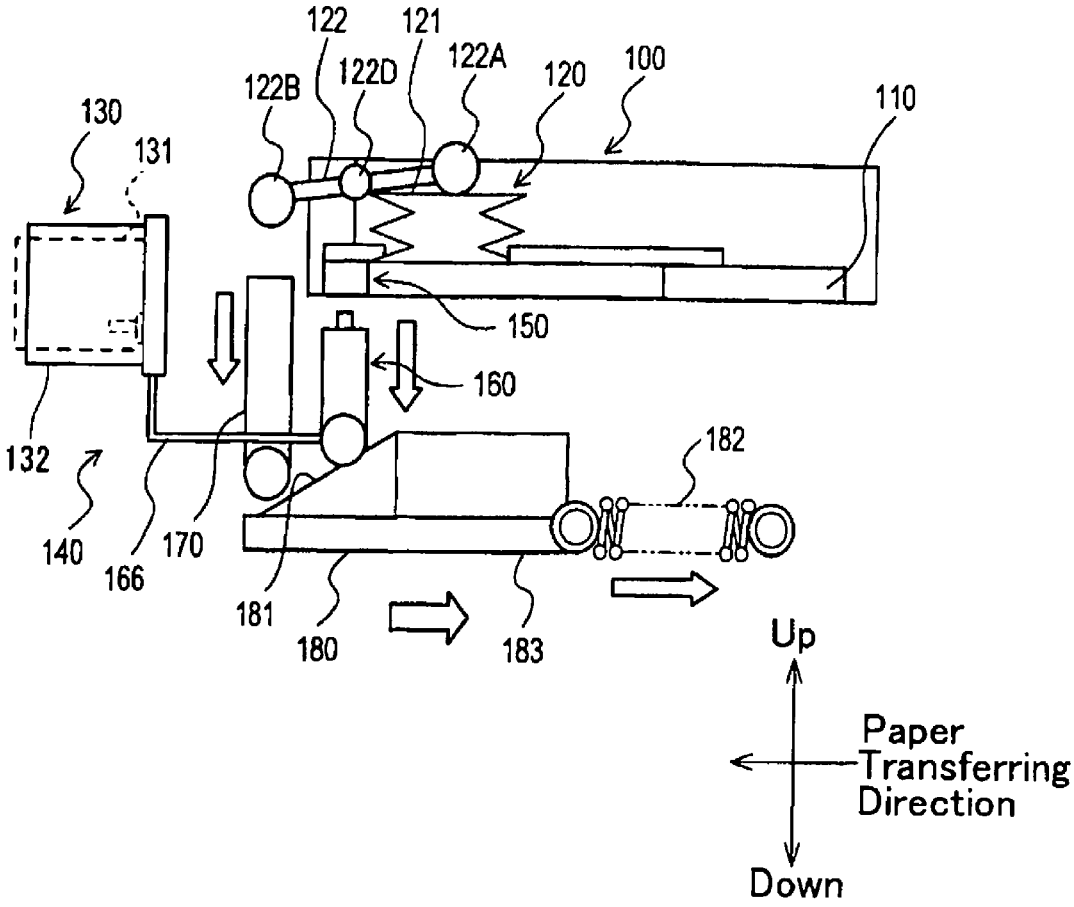
FIG. 2 is an explanatory view of an ink replenishment operation.

As shown in FIG. 2, a first end 122A of the pushing lever 122 is connected rotatably with an upper end portion of the sub ink tank 121. A second end 122B of the pushing lever 122 extends to the exterior past an outer side of an outer edge of the recording head unit 100. A supporting portion 122D is formed between the first end 122A and the second end 122B of the pushing lever 122. The supporting portion 122D is fixed to a main body portion of the recording head unit 100. The supporting portion 122D supports the pushing lever 122 in a manner allowing the pushing lever 122 to swing.

2. Main Tank Unit

The main tank unit 130 includes a casing 132 capable of housing a plurality of ink cartridges (main ink tanks) 131. The ink cartridges 131 are filled with ink for replenishing the corresponding sub ink tanks 121. The ink cartridges 131 can be joined detachably to the casing 132.

3. Station Type Ink Supply Mechanism 3.1 Schematic Configuration of a Station Type Ink Supply Mechanism A station type ink supply mechanism (hereafter termed ink supply mechanism) 140 includes a plurality of sub ink tank side connectors 150, a plurality of main ink tank side connectors 160, a push rod 170, a slide cam 180, etc. The push rod 170 pushes the second end 122B of the pushing lever 122. The slide cam 180 causes the main ink tank side connectors 160 and the push rod 170 to operate.

The sub ink tank side connectors 150 are fixed to the main body portion of the recording head unit 100. The sub ink tank side connectors 150 are connecting valves that communicate with the sub ink tanks 121. The sub ink tank side connectors 150 are formed in a number corresponding to the number of sub ink tanks 121. The sub ink tank side connectors 150 are disposed so as to be aligned in adjacent series in the main scanning direction (i.e. the left-right direction of FIG. 1). In the printer 10, the sub ink tank side connectors 150 are aligned in the sequence, from the left side of FIG. 1 as follows: cyan, magenta, yellow, photo black, and black.

Figure 3:
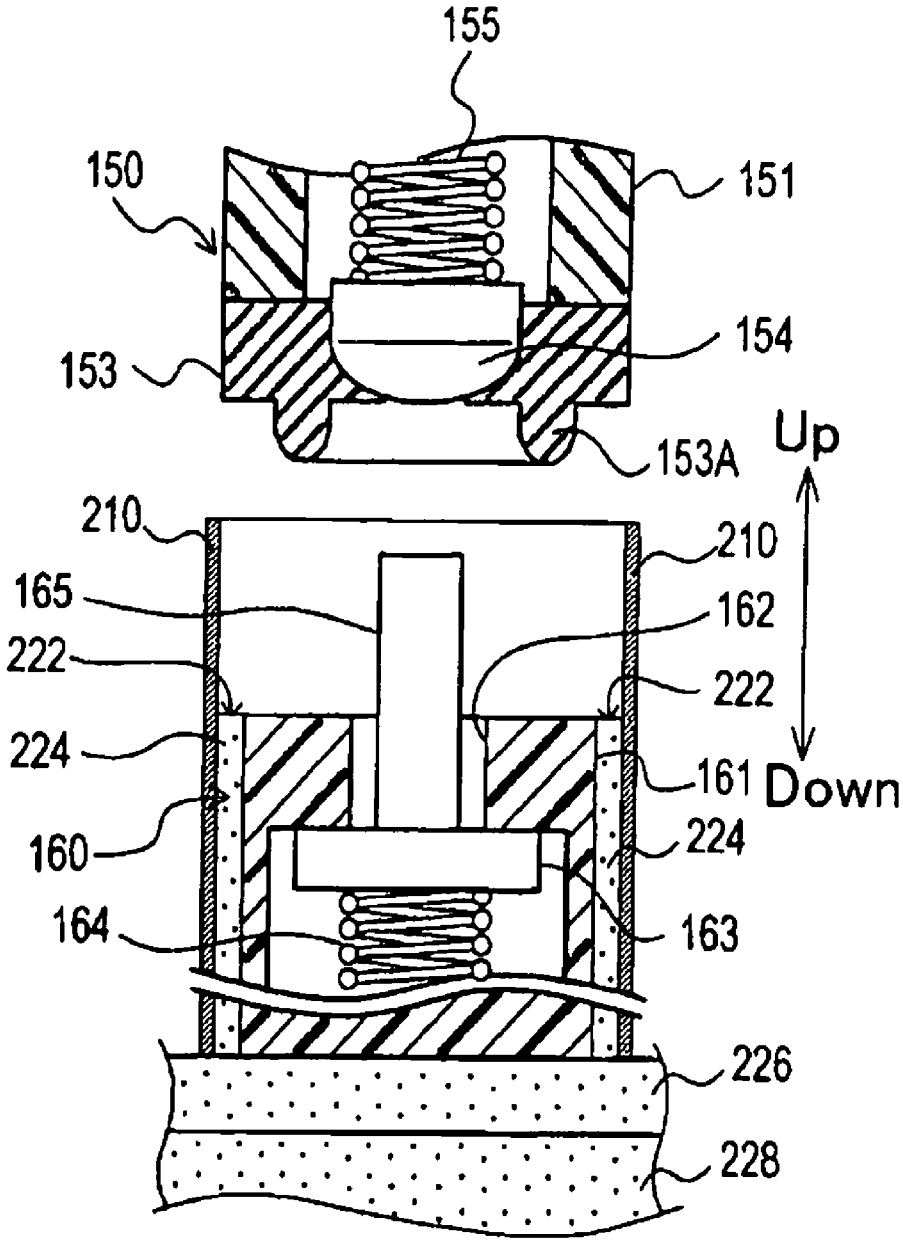
FIG. 3 is a cross section of a main tank side connector and a sub tank side connector.

As shown in FIG. 3, each sub ink tank side connector 150 includes a valve housing 151, a valve cap 153, a valve 154, a coiled spring 155, etc. The valve housing 151 is substantially cylindrical in shape. The valve cap 153 is fixed in a watertight manner at the main ink tank side connector 160 side of the valve housing 151. The valve cap 153 is formed from a resilient material such as elastomer or the like. A projecting portion 153A is formed on the main ink tank side connector 160 side of the valve cap 153. The projecting portion 153A projects in a ring shape toward the main ink tank side connector 160 so as to surround the circumference of a valve opening 152.

The coiled spring 155 is a resilient member that pushes the valve 154 from an inner side thereof in a direction for closing the valve opening 152. The initial weighting and spring constant of the coiled spring 155 is set such that the sum of F1+F2 is substantially the same or slightly greater than F3, where F1 is a pushing force for pushing the valve 154 in a direction of closing the valve opening 152 by means of pressure in the valve housing 151; F2 is a pushing force exerted by the coiled spring 155; and F3 is a pushing force in which atmospheric pressure pushes the valve 154 in a direction of opening the valve opening 152.

The sub ink tank side connectors 150 and the sub ink tanks 121 communicate at an upper side of the sub ink tanks 121. The sub ink tanks 121 and the recording head 110 communicate at a lower side of the sub ink tanks 121.

When ink is to be replenished from the ink cartridge 131 to the sub ink tank 121, the main ink tank side connector 160 is connected with the sub ink tank side connector 150, and the sub ink tank 121 communicates with the ink cartridge 131 (hereinafter, this state is referred to as the first positional relationship). The main ink tank side connector 160 moves so as to connect with or separate from (i.e. move in the up-down direction in the present embodiment) the sub ink tank side connector 150. The main ink tank side connector 160 and the sub ink tank side connector 150 are separated by means of the main ink tank side connector 160 moving with respect to the sub ink tank side connector 150 (hereinafter, this state is referred to as the second positional relationship).

Figure 4:
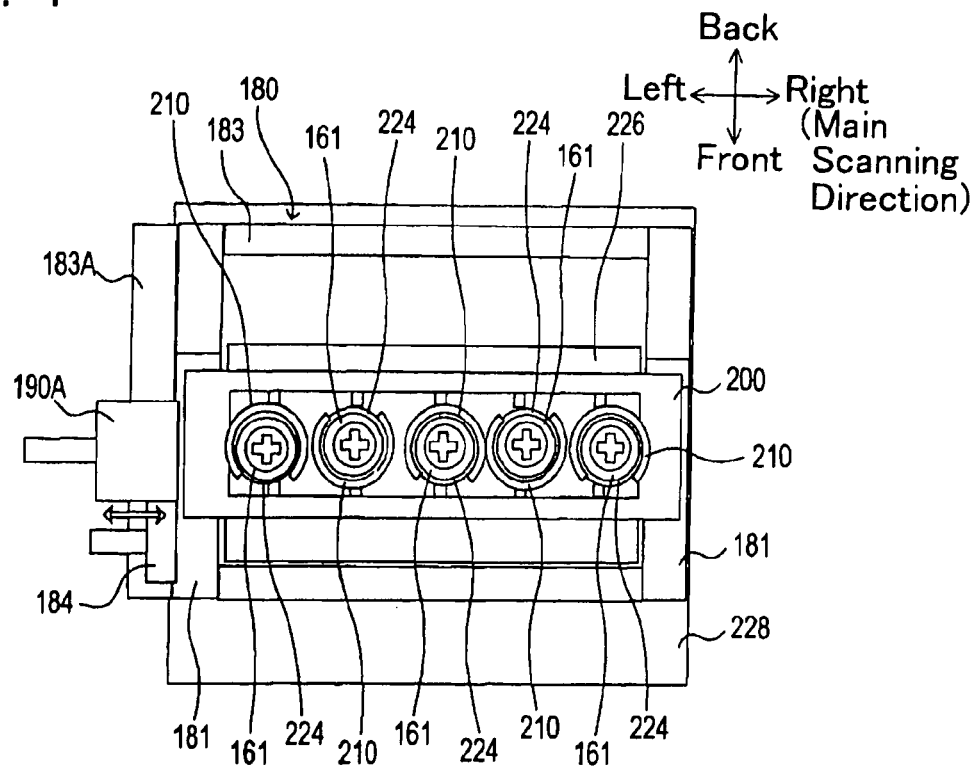
FIG. 4 is a schematic view from above of a main ink tank side connector.

As shown in FIG. 4, the main ink tank side connectors 160 are formed in a number that corresponds to the number of ink cartridges 131. Each main ink tank side connector 160 communicates with one of the ink cartridges 131 that is housed within the casing 132. The main ink tank side connectors 160 are fixed in a case 200 so as to be aligned in adjacent series in the main scanning direction (i.e. the left-right direction of FIG. 4). The main ink tank side connectors 160 move integrally with the case 200 so as to connect with or separate from the sub ink tank side connector 150 (in the up-down direction of the printer 10). As shown in FIG. 2, the main ink tank side connectors 160 communicate with the ink cartridges 131 via an ink supply tube consisting of a pipe, a tube 166, etc. As shown in FIG. 3, each main ink tank side connector 160 includes a valve housing 161, a valve 163, a coiled spring 164, a push rod 165, etc. The valve housing 161 is substantially cylindrical in shape. A valve opening 162 is formed at the sub tank side connector 151 side of the valve housing 161. The valve opening 162 is opened and closed by the valve 163 disposed in a movable manner at the interior of the valve housing 161. The coiled spring 164 is a resilient member that exerts pushing force on the valve 163 in a direction of closing the valve opening 162. The push rod 165 is integral with the valve 163 and changes position integrally with the valve 163. The push rod 165 protrudes through the valve opening 162 toward the sub ink tank side connector 150. The push rod 165 pushes the valve 154 of the sub ink tank side connector 150 and opens the valve opening 152 when the main tank side connector 150 and the sub tank side connector 160 are positioned at the first position relationship.

A substantially cylindrical wall member 210 is formed on each of the main ink tank side connectors 160 and surrounds the circumference of the valve housing 161. The wall member 210 is disposed such that an edge thereof at the sub ink tank side connector 150 side is in a higher position than an edge of the push rod 165. That is, the edge of the wall member 210 is nearer the sub ink tank side connector 150 than an edge of the push rod 165. Further, the height of the wall member 210 is set such that the sub ink tank side connector 150 does not strike against the wall member 210 when the main ink tank side connector 160 and the sub ink tank side connector 150 are at the second position relationship and the sub ink tank side connector 150 has moved in the main scanning direction together with the recording head 110.

Figure 7:
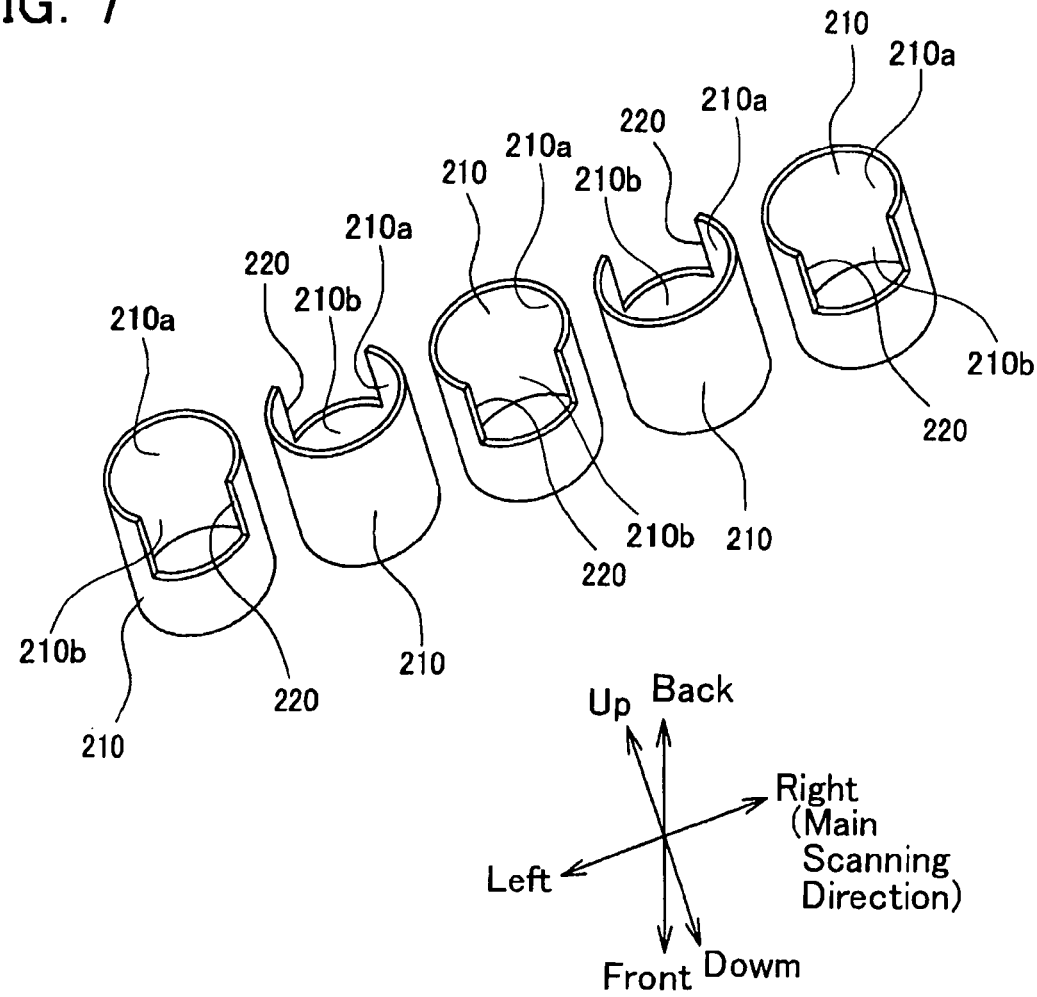
FIG. 7 is an explanatory view of a configuration of a wall member.

As shown in FIG. 7, a notch 220 is formed in each of the wall members 210. The notch 220 is notched in a rectangular shape from an edge of the sub ink tank side connector 150 side of the wall member 210 in the direction of the main ink tank side connector 160 side. In other words, the wall member 210 has a first inner surface 210*b* in which the notch 220 is not formed, and a second inner surface 210*a* in which the notch 220 is formed. The first inner surface 210*b* is near the sub ink tank side connector 150, and the second inner surface 210*a* is far from the sub ink tank side connector 150 (that is, near the main ink tank side connector 160). The notch 220 is formed along an axial direction of the wall member 210 in the second inner surface 210*a* thereof. Along a circumferential direction of the wall member 210, the length of the second inner surface 210*a* is shorter than the length of the first inner surface 210*b*.

Figure 8:
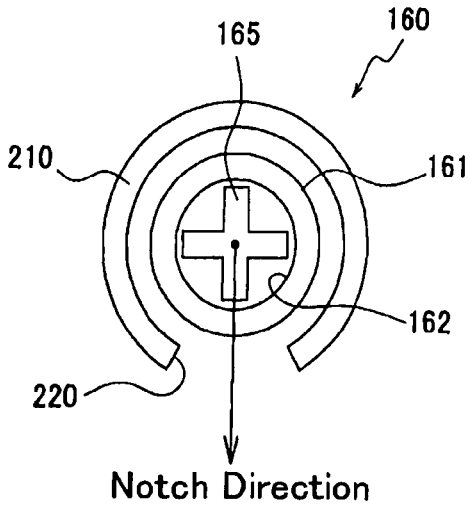
FIG. 8 is an explanatory view showing the direction of a notch formed in the wall member.

As shown in FIG. 8, a direction from a center of the valve housing 161 (the valve opening 162) toward a central point in the widthwise direction of the notch 220 (see the arrow in FIG. 8) will be considered a notch direction. As shown in FIGS. 4 and 7, the position of the notches 220 in adjacent wall members 210 is such that the notches 220 do not face one another and their mutual direction differs. Specifically, along the direction in which the wall members 210 are aligned (i.e. the left-right direction), the notches 220 are formed so as to be aligned in a staggered pattern that alternates the notch direction by 180 degrees such that the notch direction of the one notch 220 is toward the forward direction, the notch direction of the next notch 220 is toward the backward direction. In other words, in two adjacent wall members 210, the phase of the notch 220 along a circumferential direction of one wall member 210 is opposite from a phase of the notch 220 along a circumferential direction of the other wall member 210.

In the present embodiment, 'facing' includes not only the case where both the notches 220 in adjacent wall members 210 are entirely facing one another, but also the case where the notch direction of the notches 220 in adjacent wall members 210 is within a range that extends to the notches 220 being out of alignment, with respect to a state where they are entirely facing one another, by a predetermined angle (±90 degrees in the present embodiment).

Figure 5:
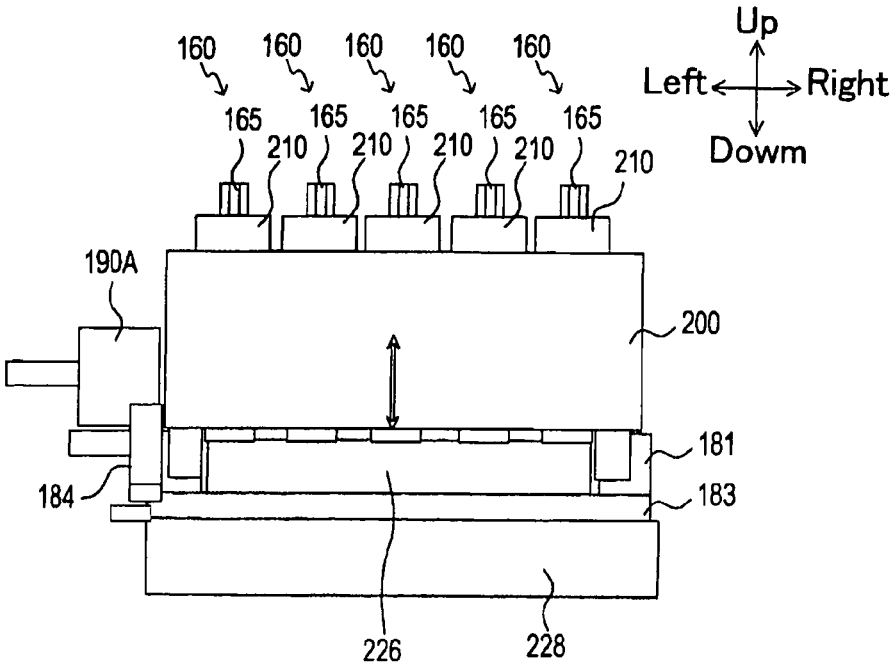
FIG. 5 is a schematic view from front of the main ink tank side connector.
Figure 6:
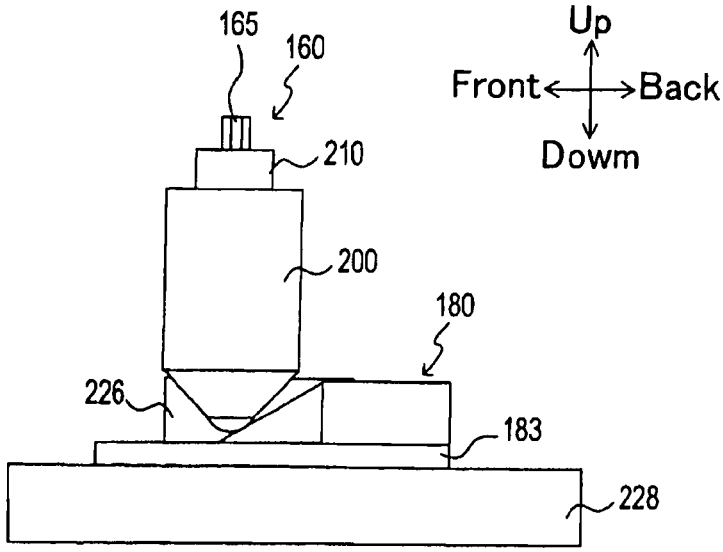
FIG. 6 is a schematic view from a right side of the main ink tank side connector.

As shown in FIG. 3, an ink path 222 is formed in a space between the wall member 210 and a side wall member of the valve housing 161. Ink that has collected between the valve housing 161 and the wall member 210 is discharged to a discharge opening 222A (see FIG. 10) at a lower side (i.e. a lower portion in the direction of gravity). A third ink absorbing body 224 for absorbing ink is disposed within the ink path 222. As shown in FIG. 5, a substantially rectangular parallelepiped shaped first ink absorbing body 226 is disposed at the discharge opening 222A side of the ink path 222. The first ink absorbing body 226 absorbs ink that was absorbed by the third ink absorbing body 224 and discharged from the discharge opening 222A. When the main ink tank side connector 160 and the sub ink tank side connector 150 are positioned at the second position relationship, the first ink absorbing body 226 covers the discharge opening 222A and makes contact with the third ink absorbing body 224. When the main ink tank side connector 160 is moved toward the sub ink tank side connector 150, the third ink absorbing body 224 (the discharge opening 222A) is separated from the first ink absorbing body 226.

A substantially rectangular parallelepiped shaped second ink absorbing body 228 is disposed at an opposite side from the main ink tank side connector 160 side of the first ink absorbing body 226. This second ink absorbing body 228 absorbs the ink that was absorbed by the first ink absorbing body 226. The second ink absorbing body 228 is formed in a state wherein it constantly makes contact with the first ink absorbing body 226. The second ink absorbing body 228 has a larger size and volume than the first ink absorbing body 226 so that the ink holding capacity of the second ink absorbing body 228 is sufficiently greater than the ink holding capacity of the first ink absorbing body 226. Of the first, second, and third ink absorbing bodies 226, 228, and 224, the absorbing force of the third ink absorbing body 224 is the smallest, and the absorbing force of the second ink absorbing body 228 is the largest. The ink absorbed by the third ink absorbing body 224 can thus be sucked reliably into the first ink absorbing body 226, and the ink absorbed by the first ink absorbing body 226 can be sucked reliably into the second ink absorbing body 228. Moreover, the head pressure of the third ink absorbing body 224 is approximately 0.2 kPa, the head pressure of the first ink absorbing body 226 is approximately 0.4 kPa, and the head pressure of the second ink absorbing body 228 is approximately 0.6 kPa. Further, the first, second and third ink absorbing bodies 226, 228, and 224 consist of sponge (foam) or the like having innumerable air bubbles formed therein, or consist of innumerable fibers twisted so that innumerable air bubbles are formed in the interior thereof. These innumerable air bubbles consequently generate a capillary phenomenon that absorbs liquid such as ink, etc.

As shown in FIG. 4, cam surfaces 181 are formed on the slide cam 180. The cam surfaces 181 are formed at left and right sides of the first ink absorbing body 226. When the slide cam 180 receives driving force from a paper discharging roller 190 (to be described) and is moved to the front side in FIG. 4, the cam surfaces 181 make contact with a lower edge of the push rod 170 and an end portion in a lengthwise direction of the case 200, and move the push rod 170 and the case 200 upward. As a result, the main ink tank side connectors 160 that are fixed to the case 200 move in a lengthwise direction thereof (i.e. in the up-down direction in the present embodiment). When the transmission of the driving force from the paper discharging roller 190 is interrupted, the resilient force of a returning spring 182 moves the slide cam 180 to the back side in FIG. 4 (i.e. the right side in FIG. 2). As a result, the push rod 170, the case 200 and the main ink tank side connector 160 are to be moved downward. The slide cam 180 is integral with abase plate 183.

As shown in FIG. 1, a rack gear 183A is formed at a paper discharging roller 190 side of the base plate 183. The rack gear 183A (the base plate 183) is transmitted driving force from a gear 190A that is formed at a lengthwise end portion of the paper discharging roller 190 via a pinion gear 184. The pinion gear 184 is disposed so as to be capable of moving between a position in which it meshes with the rack gear 183A and a position in which it is away from the rack gear 183A and does not mesh therewith. The position of the pinion gear 184 is switched by an actuator of an electromagnetic solenoid or the like (not shown).

The paper discharging roller 190 transfers paper on which an image has been formed toward a discharging (discharge) opening (not shown). The paper is transferred between a left and right pair of frames 191 and is discharged.

3.2 Schematic Operation of the Ink Supply Mechanism

When the amount of ink remaining in the sub ink tank 121 is equal to or below a predetermined amount, the ink supply mechanism 140 replenishes the ink in the sub ink tank 121 by connecting the sub ink tank side connector 150 and the main ink tank side connector 160. A controlling device (not shown) for controlling the operation of the printer 10 estimates that the amount of ink remaining in the sub ink tank 121 is equal to or below the predetermined amount when the number of times that ink was discharged from the recording head 110 (including the number of times ink was discharged in a purging operation) has reached a predetermined number of times since the previous time that ink was replenished into the sub ink tank 121.

Figure 9:
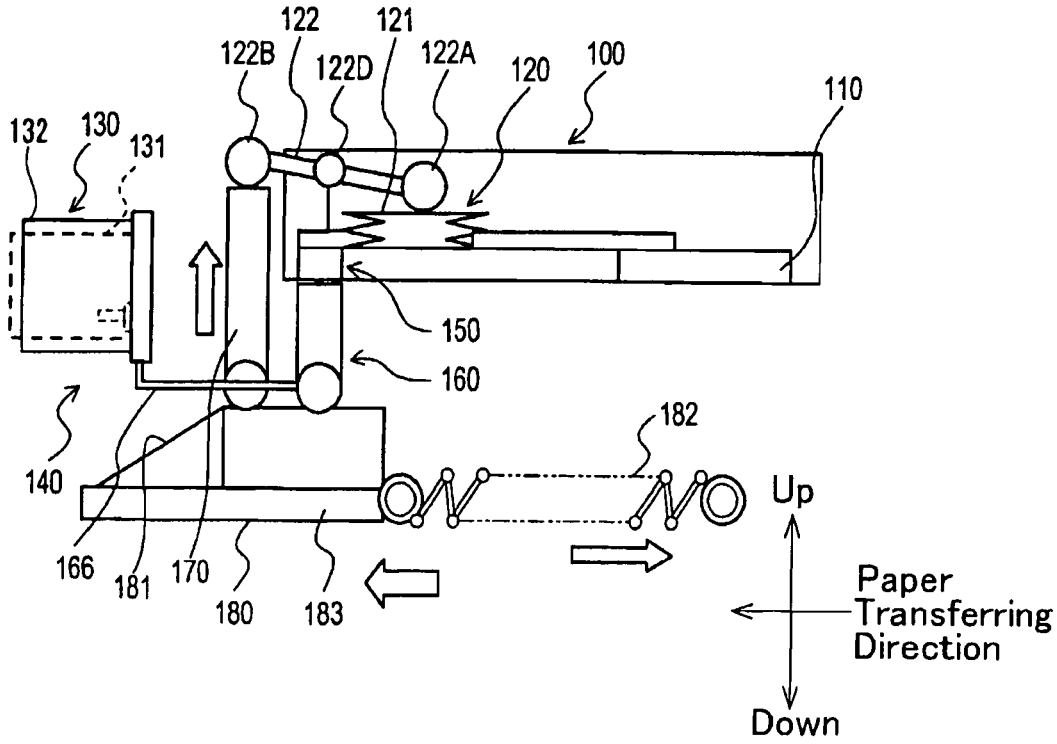
FIG. 9 is an explanatory view of the ink replenishment operation.
Figure 10:
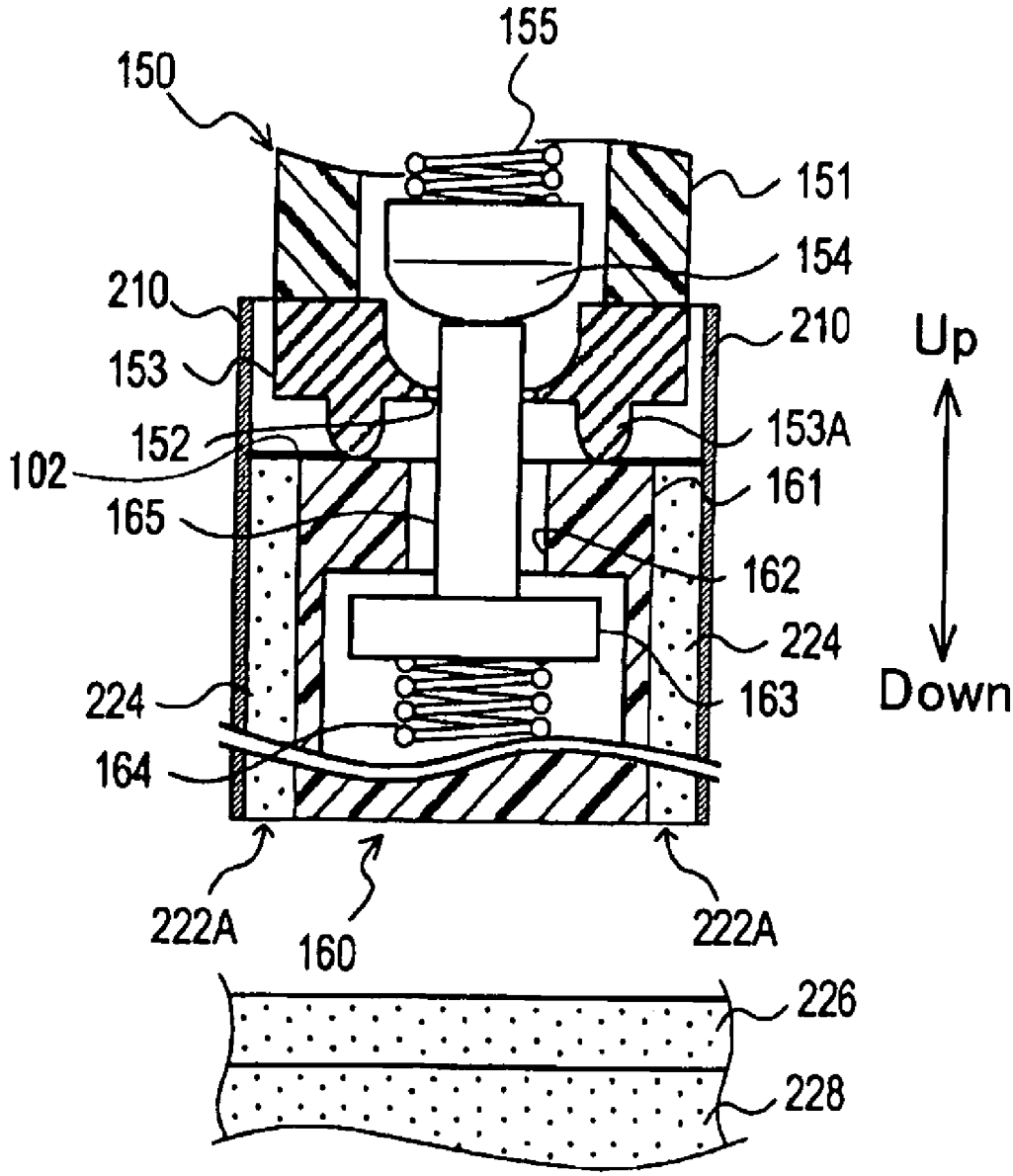
FIG. 10 is a schematic view of the connection portion during the ink replenishment operation.

In the case where the controlling device of the printer 10 determines that the amount of ink remaining in the sub ink tank 121 is equal to or below the predetermined amount, the pinion gear 184 is moved to the position where it meshes with the rack gear 183A, and the paper discharging roller 190 is made to rotate. As shown in FIG. 9, the slide cam 180 is thus moved forward in the paper transferring direction. The push rod 170 and the case 200 (the main ink tank side connector 160) are pushed by the slide cam 180 and are moved upward. The main ink tank side connector 160 is thus separated from the first ink absorbing body 226. As shown in FIG. 10, when the main ink tank side connector 160 is separated from the second ink absorbing body 226 and moved upward, the push rod 165 of the main ink tank side connector 160 pushes up the valve 154 of the sub ink tank side connector 150, and opens the valve opening 152. Simultaneously, the valve 163 of the main ink tank side connector 160 receives pushing force, via the push rod 165, in the direction of opening the valve opening 162. The valve 163 moves downward, the valve opening 162 opens, and the sub ink tank 121 and the ink cartridge 131 achieve a communicating state. As shown in FIG. 9, since the tip end of the push rod 170 pushes up the second end 122B of the pushing lever 122, the first end 122A of the pushing lever 122 swings downward and compresses the sub ink tank 121. The ink remaining in the sub ink tank 121 consequently returns to the ink cartridge 131.

If the sub ink tank 121 is compressed before the main ink tank side connector 160 and the sub ink tank side connector 150 are connected, there is a high likelihood of ink leaking out from a connection portion of the main ink tank side connector 160 and the sub ink tank side connector 150 when the main ink tank side connector 160 and the sub ink tank side connector 150 are connected. For this reason, in the printer 10, the shape of the cam surfaces 181 and the direction of operation of the slide cam 180 are set such that the compression of the sub ink tank 121 begins after the sub ink tank side connector 150 and the main ink tank side connector 160 have been connected. Further, there is the risk that a meniscus formed in a discharge opening of the recording head 110 will be destroyed if the compressing force is excessive when the sub ink tank 121 is being compressed. For this reason, the shape of the cam surfaces 181 and the speed of operation of the slide cam 180 are set so as to compress the sub ink tank 121 with a pressure that will not destroy the meniscus (for example, 4 kPa or below).

Figure 11:
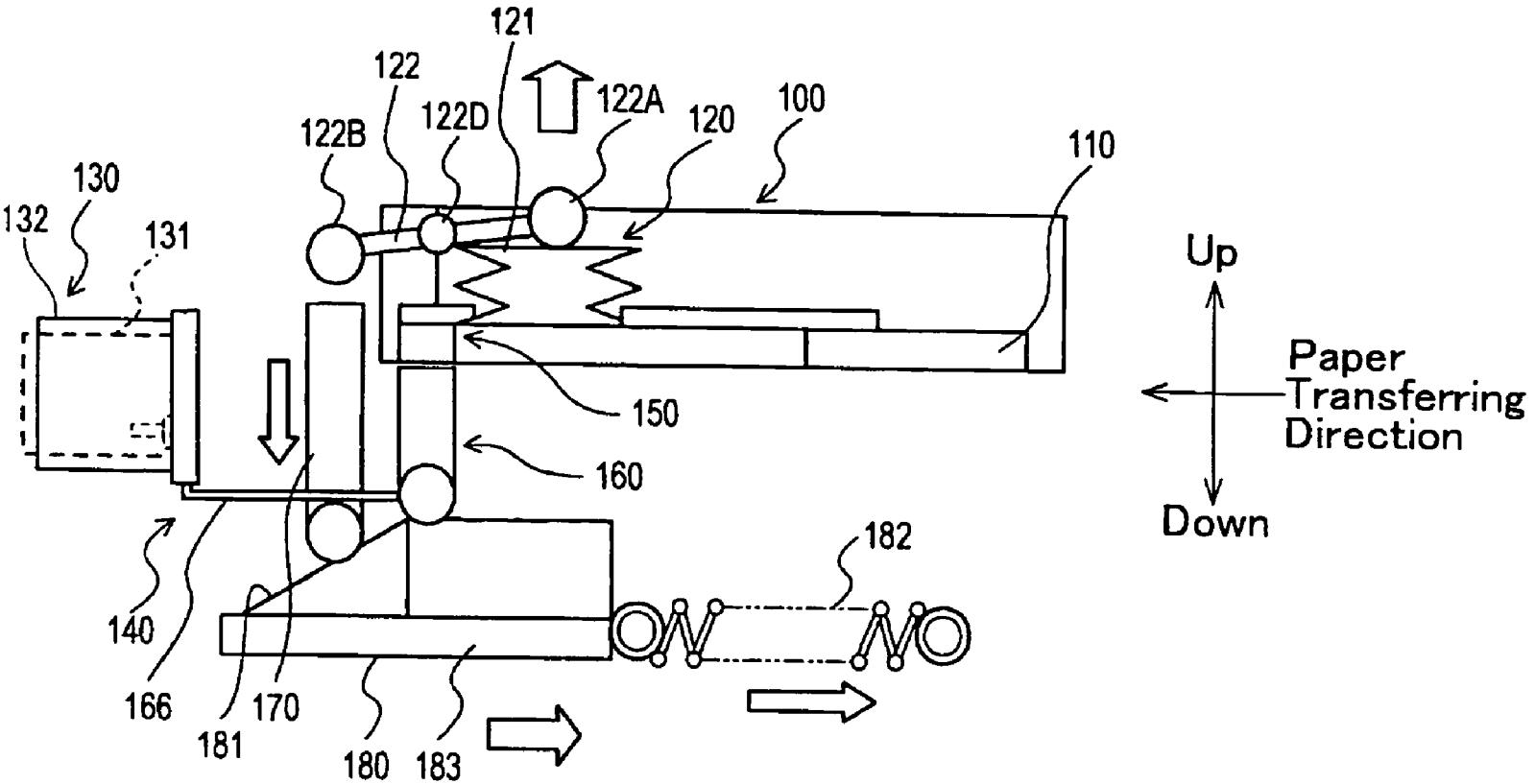
FIG. 11 is an explanatory view of the ink replenishment operation.

When a predetermined amount of time has passed or the total number of rotations of the paper discharging roller 190 has reached a predetermined number after the pinion gear 184 has been moved to the position in which it meshes with the rack gear 183A and the paper discharging roller 190 has been made to rotate, the controlling device of the printer 10 considers that the compression of the sub ink tank 121 is complete. The controlling device of the printer 10 moves the pinion gear 184 to the position in which it does not mesh with the rack gear 183A, and the rotation of the paper discharging roller 190 is halted. As shown in FIG. 11, the slide cam 180 thus begins to move in the opposite direction of the paper transferring direction. The push rod 170 moves downward, and the sub ink tank 121 expands due to its own restoring force. The ink in the ink cartridge 131 is consequently sucked into the sub ink tank 121, replenishing the ink therein. The slide cam 180 is moved further opposite of the paper transferring direction, as shown in FIG. 2, whereupon the push rod 170 separates from the pushing lever 122. The sub ink tank side connector 150 and the main ink tank side connector 160 are thus disconnected, and the valve opening 152 of the sub ink tank side connector 150 and the valve opening 162 of the main ink tank side connector 160 close.

If the sub ink tank side connector 150 and the main ink tank side connector 160 are disconnected while the push rod 170 and the pushing lever 122 are making contact, there is a high risk of ink leaking from the connection portion. In the printer 10, the shape of the cam surfaces 181 and the direction of operation of the slide cam 180 are set such that the sub ink tank side connector 150 and the main ink tank side connector 160 are disconnected after the push rod 170 has been separated from the pushing lever 122.

When an image is to be formed, the sub ink tank side connector 150 and the main ink tank side connector 160 are disconnected and the valve opening 152 of the sub ink tank side connector 150 and the valve opening 162 of the main ink tank side connector 160 are closed. When the ink within the sub ink tank 121 is consumed this sub ink tank 121 changes shape resiliently so as to become compressed. As a result, the pressure within the sub ink tank 121 is reduced, and this reduced pressure (negative pressure) within the sub ink tank 121 maintains the meniscus formed in the recording head 110. At this juncture, if a large amount of the ink within the sub ink tank 121 is consumed and the pressure within the sub ink tank 121 falls excessively, there is the risk of the pressure difference between atmospheric pressure and the pressure within the sub ink tank 121 becoming too great and destroying the meniscus.

In the printer 10, the initial weighting and spring constant of the coiled spring 155 is set such that the sum of F1+F2 is substantially the same or slightly greater than F3, where F1 is the pushing force for pushing the valve 154 in the direction of closing by means of the pressure in the valve housing 151; F2 is the pushing force exerted by the coiled spring 155; and F3 is the pushing force in which the valve 154 is pushed in the direction of opening by atmospheric pressure. As a result, the sub ink tank side connector 150 opens if the pressure within the sub ink tank 121 falls excessively, and the pressure within the sub ink tank 121 consequently rises. If the pressure difference between atmospheric pressure and the pressure within the sub ink tank 121 becomes equivalent to the pushing force of the coiled spring 155, the sub ink tank side connector 150 closes, and the pressure within the sub ink tank 121 is maintained at a pressure suitable for maintaining the meniscus. That is, in the present embodiment, the sub ink tank side connector 150 is controlled to open and close mechanically such that a pressure difference between atmospheric pressure and the pressure within the sub ink tank 121 is maintained to be equivalent to the pushing force of the coiled spring 155.

In the printer 10, when the sub ink tank side connector 150 and the main ink tank side connector 160 are disconnected, and the main ink tank side connector 160 is separated from the sub ink tank side connector 150, i.e. when the main ink tank side connector 160 is moved with respect to the sub ink tank side connector 150 from the first positional relationship to the second positional relationship, an ink film 102 (see FIG. 10) is formed between the first inner surface 210*b* of the wall member 210 and the projecting portion 153A of the sub ink tank side connector 150. In the printer 10, a plurality of main ink tank side connectors 160 and a plurality of sub ink tank side connectors 150 are present that correspond to a plurality of types of ink. The main ink tank side connectors 160 and sub ink tank side connectors 150 are disposed so as to be mutually adjacent. In a conventional ink jet printer, when the main ink tank side connector 160 is moved with respect to the sub ink tank side connector 150 from the first positional relationship to the second positional relationship, ink droplets may be dispersed from the connection portion thereof onto another adjacent sub ink tank side connector 150 and/or main ink tank side connector 160. If ink droplets are dispersed to another sub ink tank side connector 150 and/or the main ink tank side connector 160, these ink droplets may become mixed into the sub ink tank 121 and/or the ink cartridge 131 the next time the main ink tank side connector 160 and the sub ink tank side connector 150 are connected.

In the printer 10, the wall member 210 is provided that surrounds the connection portion of the main ink tank side connector 160 and sub ink tank side connector 150. Further, the notch 220 is formed in the second inner surface 210*a* of the wall member 210. As a result, the ink film 102, that is formed when the main ink tank side connector 160 is moved with respect to the sub ink tank side connector 150 from the first positional relationship to the second positional relationship, can be broken while it is present at the interior of the wall member 210. The ink droplets formed from the broken ink film 102 can be prevented from passing over the wall member 210 and dispersing to the other adjacent main ink tank side connector 160. It is thus possible to prevent the ink droplets that dispersed due to the ink film 102 being broken from mixing into the other adjacent main ink tank side connector 160, and the mixing of ink colors can thus be prevented.

In an ink jet printer using a plurality of types of ink, some ink droplets from the ink film that has been broken within the wall member may disperse from the notch to the exterior of the wall member. In this case, it is possible that, due to the positional relationship of notches formed in adjacent wall members, the dispersed ink droplets enter the adjacent wall member via the notch in that adjacent wall member. In the printer 10, the notches 220 in adjacent wall members 210 are formed so as to not face one another. That is, each wall member 210 has no notch present within a dispersal range in which ink droplets disperse to the exterior of the adjacent wall member 210 from the notch 220. Further, in the printer 10, the notches 220 are formed in a staggered pattern along the direction in which the walls 210 are aligned. It is possible to more reliably prevent ink droplets that have dispersed to the exterior of the wall member 210 from the notch 220 from entering the inner space of the adjacent wall member 210. As a result, even if the ink droplets disperse to the exterior of the main ink tank side connector 160 from the notch 220, the wall member 210 of the adjacent main ink tank side connector 160 can prevent these dispersed ink droplets from entering the interior of this adjacent main ink tank side connector 160, and the mixing of ink colors can thus be reliably prevented.

Further, in the printer 10, the ink path 222 is formed between the main ink tank side connector 160 and the wall member 210 in order to discharge ink droplets that have collected. Ink that has collected at the inner side of the wall member 210 can be discharged from the ink path 222. It is possible to prevent ink from accumulating at the inner side of the wall member 210. Furthermore, even if ink of another color has collected at the inner side of the wall member 210, this ink can be discharged along the ink path 222. It is consequently possible to prevent ink of another color that has collected within the wall member 210 from becoming mixed into the ink cartridge 131 and/or the sub tank 121 the next time the main ink tank side connector 160 and the sub ink tank side connector 150 are connected.

Further, in the printer 10, the first ink absorbing body 226 is disposed at the bottom side of the discharge opening 222A of the ink path 222. The ink that has been discharged from the discharge) opening 222A can be recovered by the first ink absorbing body 226. It is thus possible to prevent ink from leaking within the interior of the printer 10.

Further, in the printer 10, the ink that was absorbed by the first ink absorbing body 226 is absorbed by the second ink absorbing body 228. The second absorbing body 228 absorbs ink that was absorbed by the first absorbing body 226. As a result, the absorbency of the first absorbing body 226 is restored. Ink that has collected at the inner space of the wall member 210 can effectively be made to flow to the ink path 222.

Further, in the printer 10, the third ink absorbing body 224 is disposed in the ink path 222. As a result, the ink that has collected within the wall member 210 is absorbed by the third ink absorbing body 224, and the ink can be made to flow smoothly along the ink path 222 irrespective of the width of the ink path 222.

Second Embodiment

Figure 12:
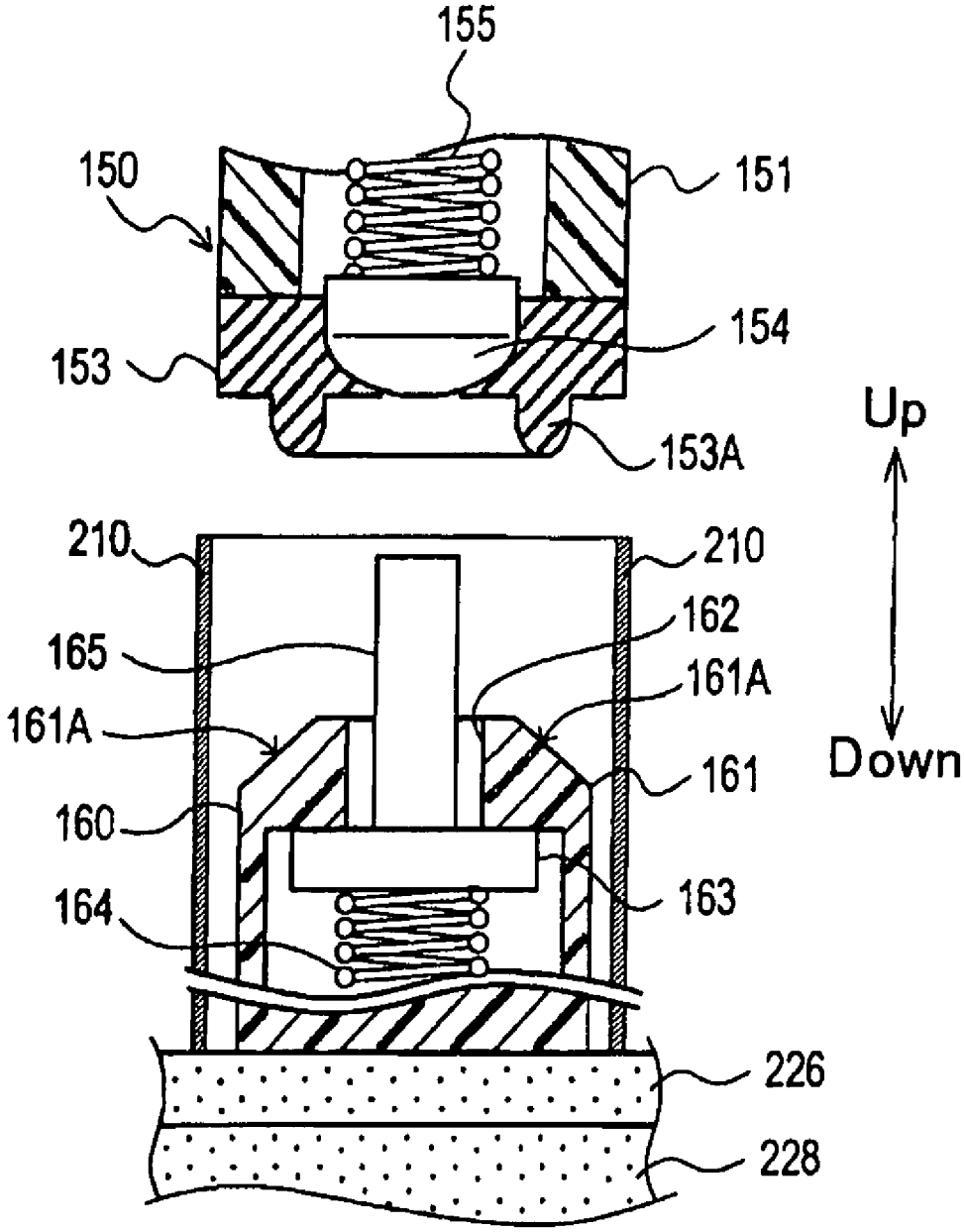
FIG. 12 is a cross section of a main ink tank side connector and a sub ink tank side connector of the second embodiment.

FIG. 12 is a schematic view of the sub ink tank side connector 150 and the main ink tank side connector 160 of a second embodiment.

In the first embodiment, the third ink absorbing body 224 is disposed in the ink path 222. However, as shown in FIG. 12, in the second embodiment, the third ink absorbing body 224 is eliminated. Moreover, an inclined surface 161A that inclines toward the wall member 210 is formed at an edge of the sub ink tank side connector 150 side of the valve housing 161.

In the printer 10 of the second embodiment, as with the printer 10 of the first embodiment, the ink film can be broken at the interior of the wall member 210. As a result, the ink droplets formed from the broken ink film can be prevented from passing over the wall member 210 and dispersing into the wall member 210 of the other adjacent main ink tank side connector 160, and the mixing of ink colors can thus be prevented.

Further, in the main ink tank side connector 160 of the second embodiment, the inclined surface 161A is formed in the valve housing 161. As a result, the ink droplets that have collected within the wall member 210 can be made to flow smoothly along the ink path 222.

Third Embodiment

Figure 13:
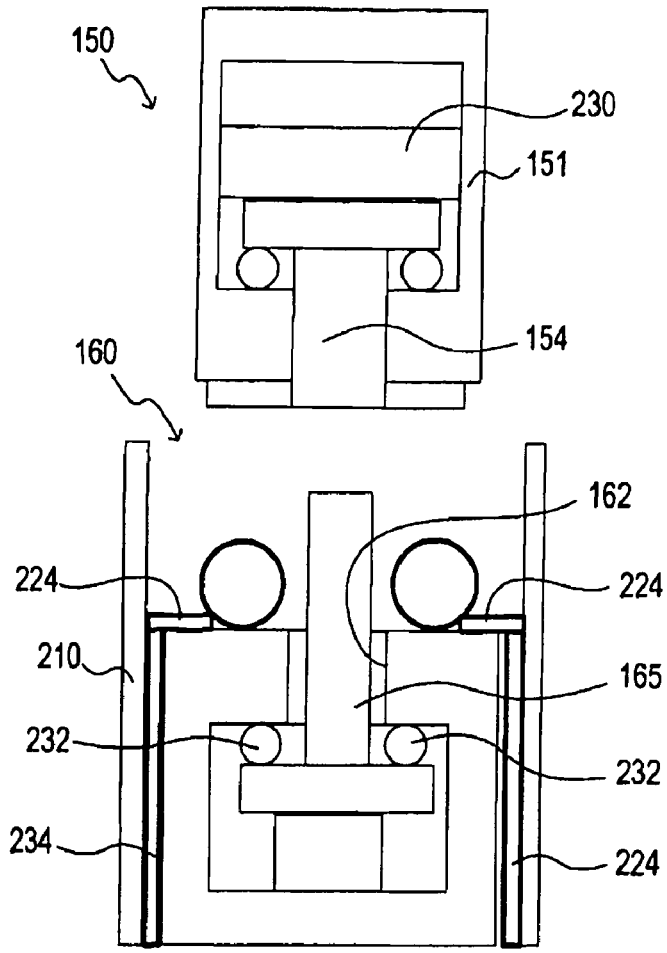
FIG. 13 is a schematic view of a main ink tank side connector and a sub ink tank side connector of the third embodiment.

FIG. 13 is a schematic view of the sub ink tank side connector 150 and the main ink tank side connector 160 of a third embodiment.

In the first and second embodiments, the sub ink tank side connector 150 was controlled to open and close in accordance with the pressure in the sub ink tank 121 in order to maintain the meniscus of the recording head 110. However, in the third embodiment, a porous member 230, such as sponge, foam, etc., is disposed in the valve housing 151 of the sub ink tank side connector 150. The meniscus is maintained utilizing the capillary absorbing force generated by the porous member 230.

Fourth Embodiment

Figure 14:
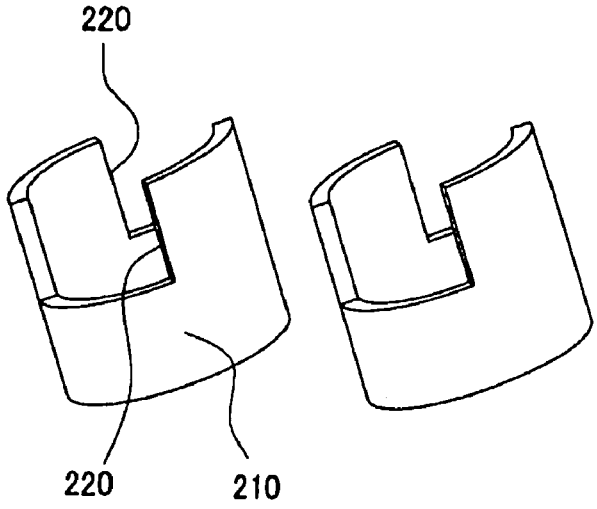
FIG. 14 is an explanatory view describing the configuration of a wall member of the fourth embodiment.

FIG. 14 is an explanatory view describing the configuration of the wall member 210 of a fourth embodiment.

In the first, second, and third embodiments, one notch 220 is formed in one wall member 210. However, in the fourth embodiment, two notches 220 are formed in one wall member 210. The notches 220 are formed in both side surfaces of the wall member 210 in directions perpendicular to the direction in which the wall member 210 is aligned.

Other Embodiments

In the above embodiments, the notches 220 are formed in a rectangular shape. However, the present embodiment is not limited to this shape, and the notches 220, for example, may equally well be formed in a V shape or W shape. Further, the notches 220, for example, may equally well be openings cut out from a portion of the wall member 210.

Further, in the above embodiments, the notches 220 are formed in the wall member 210 so as to be aligned in a staggered shape along the direction in which the wall member 210 is aligned (the left-right direction of FIG. 3). However, the present embodiment is not limited to this.

Further, in the above embodiments, the wall member is formed in a substantially cylindrical shape. However, the present embodiment is not limited to this shape, and the wall member may for example equally well be formed in an angular tubular shape.

Further, in the above embodiments, the main ink tank side connector 160 is configured so as to move up and down. However, the present embodiment is not limited to this, and the main ink tank side connector 160 may for example be configured so as to move in a horizontal direction.

Figure 15:
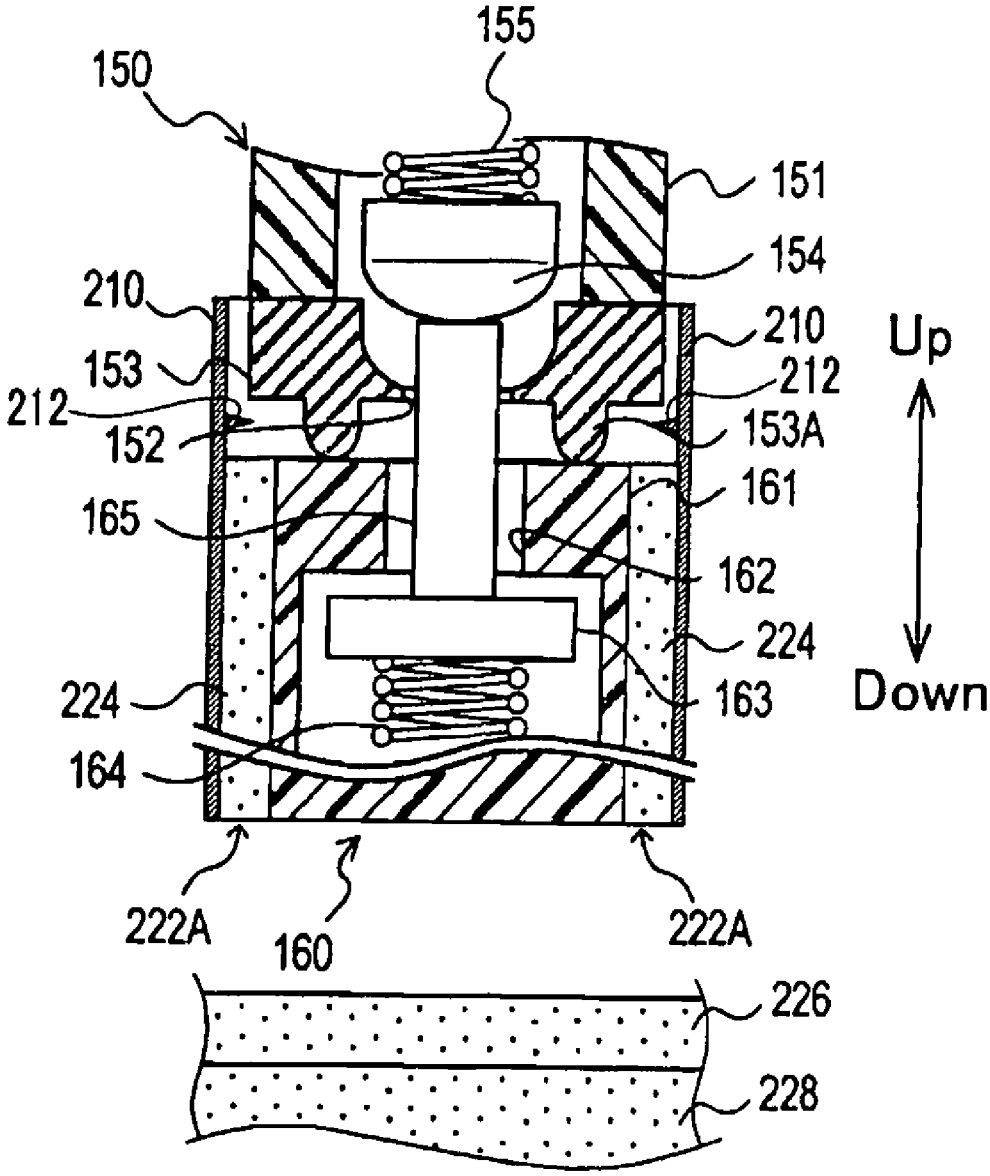
FIG. 15 is an explanatory view schematically showing a main ink tank side connector and a sub ink tank side connector of another embodiment.
Figure 16:
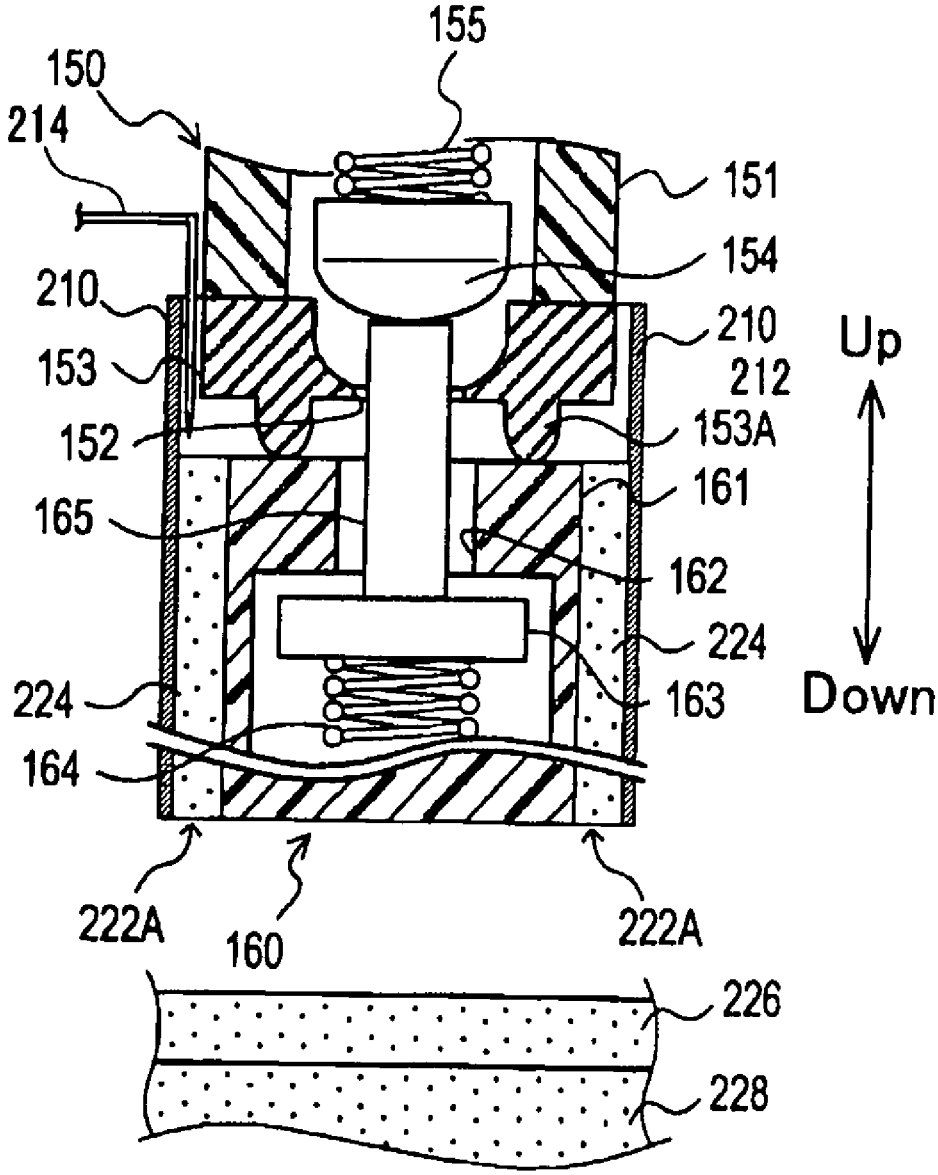
FIG. 16 is an explanatory view schematically showing a main ink tank side connector and a sub ink tank side connector of another embodiment.

Further, in the above embodiments, the ink film is broken within the wall member 210 by forming the notch 220 in the wall member 210. However, the present embodiment is not limited to this shape. For example, as shown in FIG. 15, a projecting portion 212 such as a needle or the like may be formed on the second inner circumference surface 210*a* of the wall member 210. Two projecting portions 212 are formed on the inner circumference surface of the wall member 210. The ink film can be broken at the interior of the wall member 210 by these projecting portions 212. The projecting portions 212 are formed so as to face one another. Alternatively, as shown in FIG. 16, a needle 214 or the like need not be formed at the interior of the wall member 210. The needle 214 is formed at a location of the printer 10 other than the wall member 210. In this case, the needle 214 is disposed so as not to move with respect to the wall member 210. With this configuration, also, the ink film can be broken at the interior of the wall member 210.

Further, in the above embodiments, the two ink absorbing bodies 226 and 228 are disposed at the lower side of the discharge opening 222A. However, the present embodiment is not limited to this, and only one ink absorbing body may be provided, or three or more ink absorbing bodies may be provided.

Further, in the above embodiments, the third ink absorbing body 224 (the discharge opening 222A) and the first ink absorbing body 226 can be separated and connected. However, the present embodiment is not limited to this, and the third ink absorbing body 224 (the discharge opening 222A) and the first ink absorbing body 226 may be in constant contact.

Further, in the above embodiments, the third ink absorbing body 224 is disposed within the ink discharging path 222. However, the present embodiment is not limited to this, and the third ink absorbing body 224 may equally well be disposed in a sub ink tank side connector 150 side wall portion of the valve housing 161.

Further, in the above embodiments, the amount of ink remaining in the ink tank 121 is estimated based on the number of times that ink was discharged. However, the present embodiment is not limited to this, and the amount of ink remaining in the sub ink tank 121 may, for example, be estimated based on a change in electrical resistance values within the sub ink tank 121.

Further, in the above embodiments, the sub ink tank 121 is compressed when ink is to be replenished into the sub ink tank 121, and the ink is replenished after the ink within the sub ink tank 121 has returned toward the ink cartridge 131. However, the present embodiment is not limited to this.

Further, in the above embodiments, the sub ink tank side connector 150 and the sub ink tank 121 communicate at the upper side of the sub ink tank 121, and the sub ink tank 121 and the recording head 110 communicate at the lower side of the sub ink tank 121. However, the present embodiment is not limited to this, and the configuration may be the inverse, i.e. the sub ink tank side connector 150 and the sub ink tank 121 communicate at the lower side of the sub ink tank 121, and the sub ink tank 121 and the recording head 110 communicate at the upper side of the sub ink tank 121.

Further, in the above embodiments, the case 200 (the main ink tank side connector 160) and the push rod 170 are moved by the slide cam 180. However, the present embodiment is not limited to this, and the case 200 and the push rod 170 may for example be moved by an electric actuator such as an electromagnetic solenoid or the like.

Further, in the above embodiments, the valve 163 and an outer edge portion of the valve opening 162 make contact directly. However, the present embodiment is not limited to this, and a sealing means such as an O ring 232 (see FIG. 13) or the like may be disposed at a contacting portion of the valve 163 and the outer edge portion of the valve opening 162.

Further, in the above embodiments, a breaking portion is the notch 220 formed in the wall member 210. Alternatively, the wall member 210 includes the base portion 210 and the projecting portion 212 that projects from an inner surface of the base portion 210. The breaking portion is the projecting portion 212 of the wall member 210. With this configuration, it is possible to form the breaking portion easily.

Further, the ink jet printer of the present invention may of course be utilized as a printer while connected with a personal computer, but may also be utilized while connected for example with a printer portion of a facsimile device.

Further, the present embodiment may conform to the spirit or scope of the appended claims, and is not restricted to the specifications described above.

What is claimed is:

1. An ink jet printer, comprising:

a casing comprising a space for housing a main ink tank;

a sub ink tank to which ink within the main ink tank is to be supplied;

an ink jet head to which ink within the sub ink tank is to be supplied;

a main ink tank side connector that is to be connected with the main ink tank;

a sub ink tank side connector that is to be connected with the sub ink tank, wherein the main ink tank side connector is capable of moving with respect to the sub ink tank side connector between a first positional relationship and a second positional relationship, the main ink tank side connector is connected with the sub ink tank side connector in the first positional relationship, and the main ink tank side connector is disconnected from the sub ink tank side connector in the second positional relationship;

a wall member that surrounds at least a connection portion of the main ink tank side connector and the sub ink tank side connector when the main ink tank side connector and the sub ink tank side connector are positioned in the first positional relationship; and a breaking portion, formed in or on the wall member, that breaks an ink film to be formed within an inner space of the wall member, wherein the ink film is to be formed when the main ink tank side connector moves with respect to the sub ink tank side connector from the first positional relationship to the second positional relationship, and the breaking portion breaks the ink film in a state where at least a part of the ink film exists within the wall member;

wherein the breaking portion is configured to break the ink film when the main ink tank side connector moves with respect to the sub ink tank side connector from the first positional relationship to the second positional relationship.

2. The ink jet printer as in claim 1;

wherein the breaking portion is a notch formed in the wall member; and wherein the ink film is to be generated at a position where the notch is not formed.

3. The ink jet printer as in claim 2, comprising:

a plurality of units;

wherein the casing comprises a space for housing a plurality of main ink tanks;

wherein each unit comprises the sub ink tank, the main ink tank side connector, the sub ink tank side connector, the wall member, and the notch; and wherein the notches formed in the two adjacent wall members do not face each other.

4. The ink jet printer as in claim 3;

wherein, in the two adjacent wall members, a phase of the notch along a circumferential direction of one wall member is opposite from a phase of the notch along a circumferential direction of the other wall member.

5. The ink jet printer as in claim 1;

wherein the ink film is to be formed between the wall member and the sub ink tank side connector.

6. The ink jet printer as in claim 5;

wherein the sub ink tank side connector comprises a connector side base portion and a projecting portion that projects from the connector side base portion;

wherein the projecting portion makes contact with the main ink tank side connector when the main ink tank side connector and the sub ink tank side connector are positioned in the first positional relationship; and wherein the ink film is to be formed between the wall member and the projecting portion.

7. The ink jet printer as in claim 1;

wherein the wall member comprises a wall member side base portion and a projecting portion that projects from an inner surface of the wall member side base portion;

wherein the breaking portion is the projecting portion of the wall member; and wherein the ink film is to be formed between the wall member side base portion and the sub ink tank side connector.

8. The ink jet printer as in claim 1;

wherein the wall member is coupled to the main ink tank side connector or the sub ink tank side connector.

9. The ink jet printer as in claim 8, further comprising:

an ink path located between the wall member and the connector to which the wall member is coupled.

10. The ink jet printer as in claim 9, further comprising:

a first absorbing member for absorbing ink, the first absorbing member facing a discharge opening of the ink path.

11. The ink jet printer as in claim 10, further comprising:

a second absorbing member for absorbing ink, the second absorbing member making contact with the first absorbing member.

12. The ink jet printer as in claim 10;

wherein the first absorbing member covers the discharge opening of the ink path when the main ink tank side connector and the sub ink tank side connector are positioned in the second positional relationship; and wherein the first absorbing member is separated from the discharge opening of the ink path when the main ink tank side connector and the sub ink tank side connector are positioned in the first positional relationship.

13. The ink jet printer as in claim 9, further comprising:

a third absorbing member for absorbing ink, the third absorbing member being located within the ink path.

14. An ink jet printer, comprising:

a casing comprising a space for housing a main ink tank;

a sub ink tank to which ink within the main ink tank is to be supplied;

an ink jet head to which ink within the sub ink tank is to be supplied;

a main ink tank side connector that is to be connected with the main ink tank;

a sub ink tank side connector that is to be connected with the sub ink tank, wherein the main ink tank side connector is capable of moving with respect to the sub ink tank side connector between a first positional relationship and a second positional relationship, the main ink tank side connector is connected with the sub ink tank side connector in the first positional relationship, and the main ink tank side connector is disconnected from the sub ink tank side connector in the second positional relationship; and a wall member that surrounds at least a connection portion of the main ink tank side connector and the sub ink tank side connector when the main ink tank side connector and the sub ink tank side connector are positioned in the first positional relationship;

wherein the sub ink tank side connector comprises a base portion and a projecting portion that projects from the base portion;

wherein the projecting portion makes contact with the main ink tank side connector when the main ink tank side connector and the sub ink tank side connector are positioned in the first positional relationship;

wherein the wall member comprises a first inner surface and a second inner surface, wherein, along an axial direction of the wall member, the first inner surface is near the main ink tank side connector, and the second inner surface is far from the main ink tank side connector;

wherein, along a circumferential direction of the wall member, a length of the first inner surface is different from a length of the second inner surface; and wherein an ink film is to be formed between the first inner surface of the wall member and the projecting portion of the sub ink tank side connector.

15. The ink jet printer as in claim 14;

wherein, along the circumferential direction of the wall member, the length of the first inner surface is greater than the length of the second inner surface.

16. The ink jet printer as in claim 14;

wherein, along the circumferential direction of the wall member, the length of the first inner surface is less than the length of the second inner surface.

* * * * *